United States Patent [19]

Justus

[11] Patent Number: 4,495,711

[45] Date of Patent: Jan. 29, 1985

[54] DRYER SECTION DRIVE ARRANGEMENT FOR PAPER MAKING MACHINES

[75] Inventor: Edgar J. Justus, Beloit, Wis.

[73] Assignee: Beloit Corporation, Beloit, Wis.

[21] Appl. No.: 493,799

[22] Filed: May 12, 1983

Related U.S. Application Data

[63] Continuation-in-part of Ser. No. 392,720, Jun. 28, 1982, now Defensive Publication No.

[51] Int. Cl.[3] ..... F26B 13/08

[52] U.S. Cl. ..... 34/23; 34/25; 34/52; 34/116; 34/121; 34/123

[58] Field of Search ..... 34/52, 114, 116, 117, 34/121, 122, 123, 23, 25

[56] References Cited

U.S. PATENT DOCUMENTS

| | | | |
|---|---|---|---|
| 1,533,194 | 4/1925 | Kilberry | 34/116 |
| 1,558,936 | 10/1925 | Simons | 34/121 |
| 2,077,768 | 4/1937 | Perry | 34/121 |
| 2,857,682 | 10/1958 | Olden et al. | 34/160 |
| 3,123,449 | 3/1964 | Cocker | 34/121 |
| 3,815,256 | 6/1974 | Ely | 34/111 |
| 3,938,261 | 2/1976 | Anderson | 34/114 |
| 4,183,148 | 1/1980 | Koski et al. | 34/121 |

*Primary Examiner*—Larry I. Schwartz
*Assistant Examiner*—David W. Westphal
*Attorney, Agent, or Firm*—Hill, Van Santen, Steadman & Simpson

[57] ABSTRACT

A paper making machine dryer section and a method of operating and controlling the same, wherein the dryer rolls are freely rotatable and are rotatably actuated entirely by a dryer felt drive. In a preferred arrangement, there are two tiers of cooperatively related dryer rolls over which a paper web to be dried is run in a sinuous path successively around the dryer rolls of the tiers. Each of the tiers has a respective dryer felt running over and guiding and holding the web onto the dryer roll peripheral surfaces in the associated tier. The dryer felts run under tension over guide rollers. In each tier at least one of the guide rollers is motor driven for thereby driving the associated dryer felt. While the felt of each tier effects synchronized running of all of the dryer rolls in that tier, synchronization of the motors of the tiers one with the other is effected by speed regulators connected with a frequency reference and speed control.

14 Claims, 4 Drawing Figures

POWER SUPPLY
SPEED REG.
FREQUENCY REFERENCE
SPEED CONTROL
F-1
F-2
W

DRYER SECTION DRIVE ARRANGEMENT FOR PAPER MAKING MACHINES

RELATED APPLICATION

This application is a continuation-in-part of my pending application Ser. No. 392,720 filed June 28, 1982.

BACKGROUND OF THE INVENTION

1. Field of the Invention

The present invention relates to the paper making art, and is more particularly concerned with a new and improved paper making machine dryer section drive and method.

2. Description of Prior Art

After the paper web has been dewatered in a paper making machine to the extent that it is self-supporting, the web to be dried is caused to travel through a dryer section having a plurality of rotatably mounted heated dryer drums or rolls arranged in cooperative upper and lower tiers and over which the paper web is adapted to travel in a sinuous path successively around the dryer rolls of the tiers. Respective dryer felts guide and hold the web onto the roll peripheral surfaces of each tier. Each dryer felt also functions to maintain substantial synchronism of the dryer rolls in the respective tier with which the felt is associated. Representative of this type of dryer section is the disclosure in U.S. Pat. No. 3,815,256.

In modern dryer sections, which may operate at lineal or machine direction speeds on the order of 3,000 feet per minute, it has been customary to drive the entire dryer section by means of one large driving motor and then through a long train of gears at the back side of the machine, all of the dryer rolls, which may be as many as fifteen in a typical dryer section, are driven in unison from the single motor. This requires a fairly massive and costly frame and gearbox arrangement, which interferes with cross machine moisture profile and symmetrical air flow from the paper machine basement, as well as interfering with broke removal, in contrast to the front side of the dryer section which is not encumbered with the gearbox structure. Because of the large number of gears in the train, considerable operating noise may be generated. Customarily, the gears are pressure lubricated with oil, and oil leakage can be a problem.

In addition, the gearing or transmission mechanism, housings, supports and pressure lubrication systems add a considerable expense to the cost of the paper machine installations.

SUMMARY OF THE INVENTION

An important object of the present invention is to provide a new and improved dryer section drive which will overcome the disadvantages, drawbacks inefficiencies, shortcomings and problems inherent in prior dryer section drives.

To this end, the present invention provides in a paper machine dryer section of the type having a plurality of rotatably mounted heated dryer rolls and over which a paper web to be dried is adapted to be run in a sinuous path, and dryer felt means adapted for guiding and holding the web onto the dryer roll peripheral surfaces, the improvement comprising the dryer rolls being supported in free running relation on anti-friction bearings, and means for driving the felt means for driving the dryer rolls.

The invention also provides a method of operating a machine dryer section of the type having a plurality of rotatably mounted heated dryer rolls over which a paper web is run in a sinuous path, and dryer felt means adapted for guiding and holding the web onto the dryer roll peripheral surfaces, the improvement comprising supporting the dryer rolls in free running relation on anti-friction bearings, and driving the felt means for driving the dryer rolls.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which.

DETAILED DESCRIPTION

A paper machine dryer section of the type for which the present invention is particularly adapted comprises (FIG. 1 and 4) a plurality of rotatably mounted heated dryer drums, cylinders or rolls 5 arranged in a cooperative staggered relation in upper and lower tiers 7 and 8, respectively, and over which a paper web W to be dried is adapted to be run in a sinuous path, successively wrapping the dryer rolls of the tiers 7 and 8, as shown. Although the dryer section illustrated has only six of the dryer rolls 5, arranged in three rolls in the upper tier 7 and three rolls in the lower tier 8, in a staggered relationship in the tiers, it will be understood that a larger number of rolls may be used in each tier to meet operating requirements for the particular dryer installation, and the dryer rolls may be arranged in more than two tiers and may be vertically arranged and have varying diameters. Also, there may be as many of the dryer sections operating in succession as may be desirable to accommodate paper web shrinkage as the drying proceeds. By way of example, the rolls 5 may be about 72 inches in diameter and of a length to handle a paper web about 30 feet wide, running on the order of 3,000 feet per minute.

Figure 2:
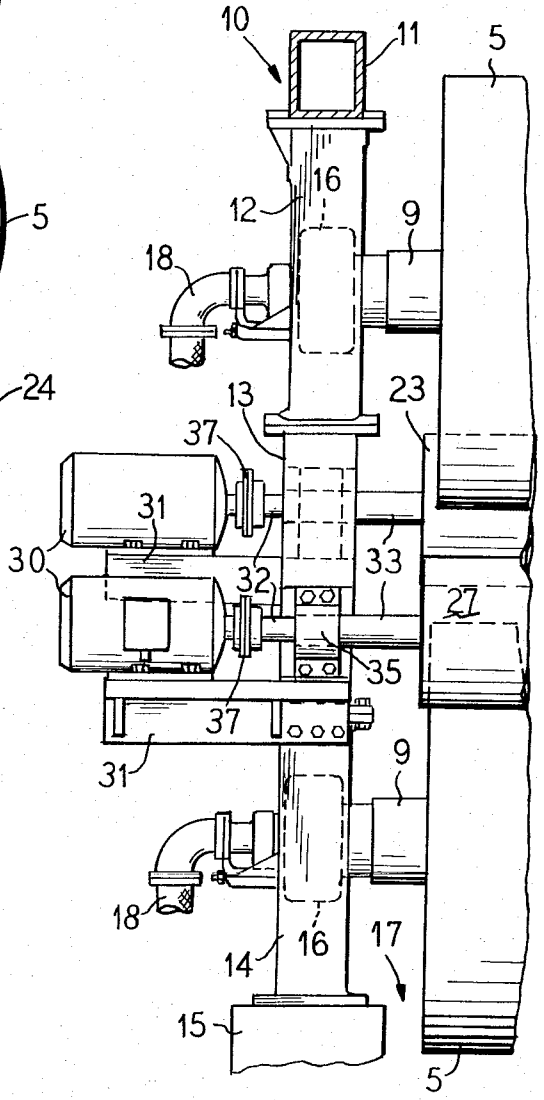
FIG. 2 is a vertical sectional elevational view taken substantially along the lines II—II of FIG. 1.

Each of the rolls 5 has axially oppositely projecting shaft means providing journals 9 (only the journals at the back side of the dryer section being shown) by which the rolls 5 are adapted to be rotatably journaled for operation within dryer section frame means 10 including longitudinally extending, that is in the machine direction, upper beams 11, only the rear or back side beam being shown. Respective bearing hanger bracket structures 12 secured to the beams 11 provide support for the journals 9 of the upper tier rolls 5. Vertical frame columns 13 extend supportingly between the hanger structures 12 and bearing block structures 14 mounted on foundation beam means 15 and adapted for journaling the journals 9 of the rolls 5 in the lower tier 8. Anti-friction bearings 16 (FIG. 3) are provided for the journals 9 of the several rolls 5 in each tier and enable rotation of the rolls 5 with minimum applied energy, or driving force. Drying air is adapted to move upwardly from a basement 17 (FIG. 2).

In a well known manner, each of the dryer rolls 5 is adapted to be heated by means of heating fluid such as steam from a suitable source supplied through a respective steam intake 18 connected to the back side journal 9 which is desirably hollow for this purpose. Spent heating fluid may be exhausted through the opposite or front side journal (not shown) which may also be hollow for this purpose. The wet web W is adapted to be guided from the web forming apparatus (not shown) of the paper making machine by means of a roller 19 onto the first in the series of one of the tiers of dryer rolls 5, shown in FIG. 4 as the first roll 5 in the upper tier 7. Thence, the web W travels successively in a serpentine path down from the upper tier dryer roll 5 to the adjacent lower tier dryer roll 5 and then up to the next upper tier dryer roll 5, and so on until the web leaves the dryer section 10 by way of a guide roller 20.

In travelling over the upper tier dryer rolls 5, the web W is held onto the individual dryer drum peripheral surfaces by an endless dryer felt F-1 formed of a porous material which may be of any type fabric suitable for the purpose and which will allow air and steam to pass through it. By way of example, the felt F-1 may be formed of plastic fabric or screen, a suitable material being a foraminous plastic screen or fabric of the type known as "Formex" fabric, which permits moisture vapor to be driven through the fabric by heated air. Above the upper tier 7, the felt F-1 runs over guide rollers 21, and is guided toward the first in the upper tier series of dryer rolls 5 by guide roller 22. Between the upper tier rolls 5, the felt F-1 is guided serpentine fashion over felt guiding and tensioning rollers 23 in a manner to effect efficient wrapping of each of the dryer rolls 5 and thus efficient contact of the web with the outer peripheries of the dryer rolls. It will be noted that the rollers 23 are located in pockets defined between the two adjacent upper tier rolls 5 and the adjacent underlying lower tier roll 5. Further, the wrap of the felt F-1 with the upper tier rolls 5 and the guide rollers 23 is approximately 50% of the peripheral surface of each of the rolls 5 and each of the guide rollers 23, whereby a particularly efficient driving torque relationship is attained by means of the felt F-1. From the last of the upper series dryer rolls 5, the felt F-1 is guided into its return run by a guide roller 24.

In similar fashion as just described for the felt F-1, an endless dryer felt F-2 wraps the peripheral surfaces of the dryer rolls 5 of the lower tier 8. A guide roller 25 guides the felt F-2 onto the first in the series of the lower tier dryer rolls 5. Between the dryer rolls 5, felt guiding rollers 27 maintain wrapping, driving torque tension on the dryer felt F-2. It will be observed that the rollers 27 are located in pockets defined between the respective two lower tier rolls 5 and the suprajacent upper tier roll 5. At the end of the lower tier roll series, a guide roller 28 guides the felt F-2 toward a return run where it travels over guide rollers 29.

Both of the felts F-1 and F-2are of full machine width, that is, at least the full width of the web W to be dried, and thus of a width equal to or substantially the full length of the dryer rolls 5. Accordingly, by maintaining adequate tension throughout the travel of each of the felts, including the return runs, the felts have large torque or drawing power capability in each of the tiers 7 and 8 of the dryer. Selective tensioning of the upper felt F-1 may be effected in well known manner by having any one of the guide rolls 21, 22 or 24 serve as an adjustable tensioning roller. Similarly desired tension in the lower felt F-2 may be attained by having any one of the guide rollers 25, 28 or 29 serve as an adjustable tensioning roller. The modulus of the felts is much greater than the modulus of the web W. Therefore, the felts by reason of their tensioned wrap on the rolls 5 are capable, among other things, of maintaining synchronous surface speed of the dryer rolls in each tier well within the stretchable range of the paper web W.

According to the present invention, driving of the dryer rolls 5 in each of the tiers 7 and 8 is effected by means of the respective dryer felts F-1 and F-2 which for this purpose are positively driven, while the dryer rolls 5 run freely on their anti-friction bearings 17. To this end, each of the dryer felts F-1 and F-2 is driven by means of at least one electrical driving motor 30, depending upon the length of the dryer section, driving torque requirements, and the like. In the present instances, two driving motors 30 have been illustrated for each of the tiers 7 and 8. In the upper tier 7, the driving motors 30 are arranged to drive the felt guiding rollers 23. In the lower tier 8, the driving motors are arranged to drive the felt guiding rollers 27. Such arrangement of the driving motors 30 is deemed the most efficient driving arrangement. However, if preferred, any one or more of the other guide rollers for the felt F-1 and for the felt F-2 may be selected for driving the respective felt.

Figure 1:
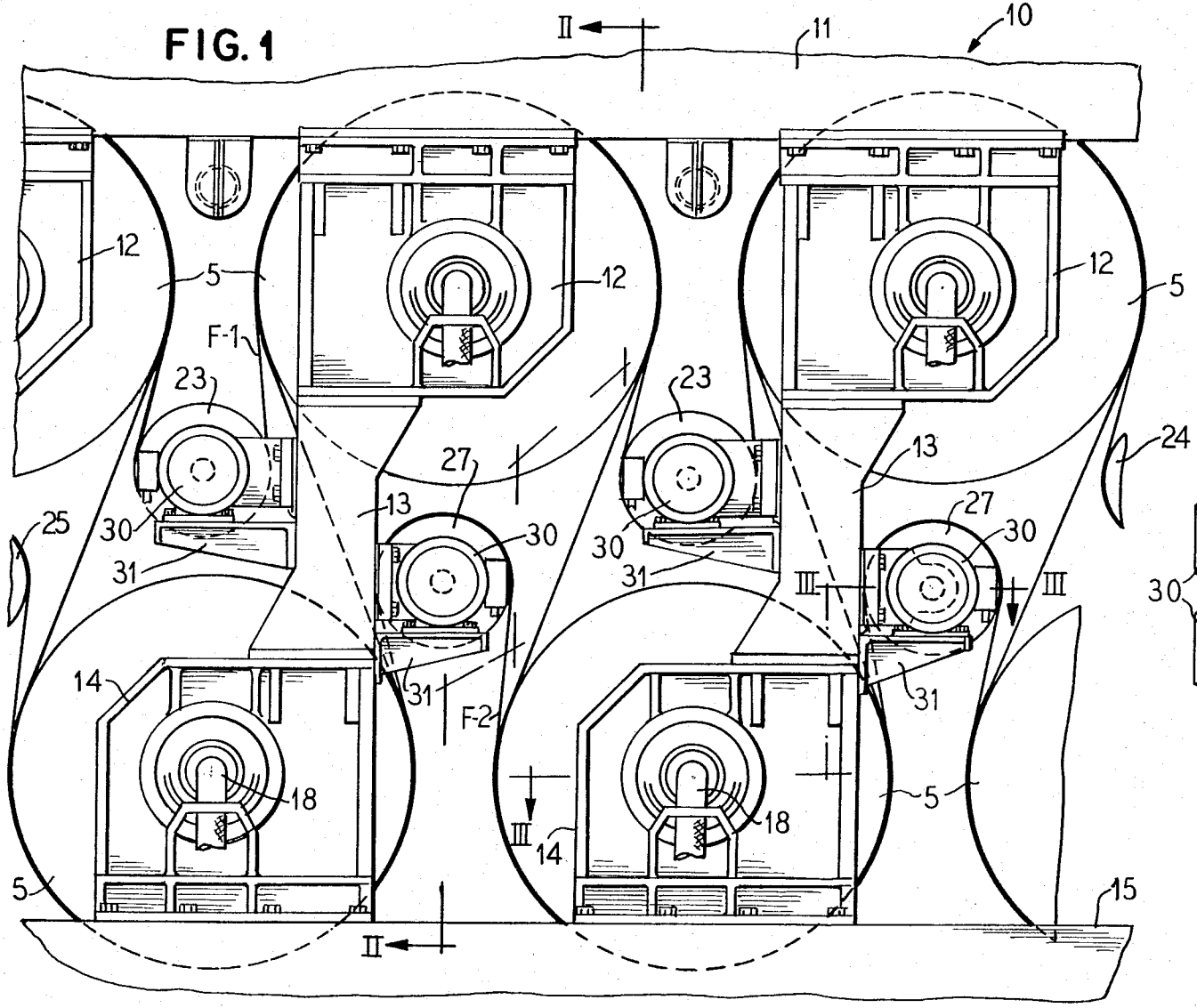
FIG. 1 is a fragmentary elevational view of the back side of a paper machine dryer section embodying the invention.
Figures 3, 4:
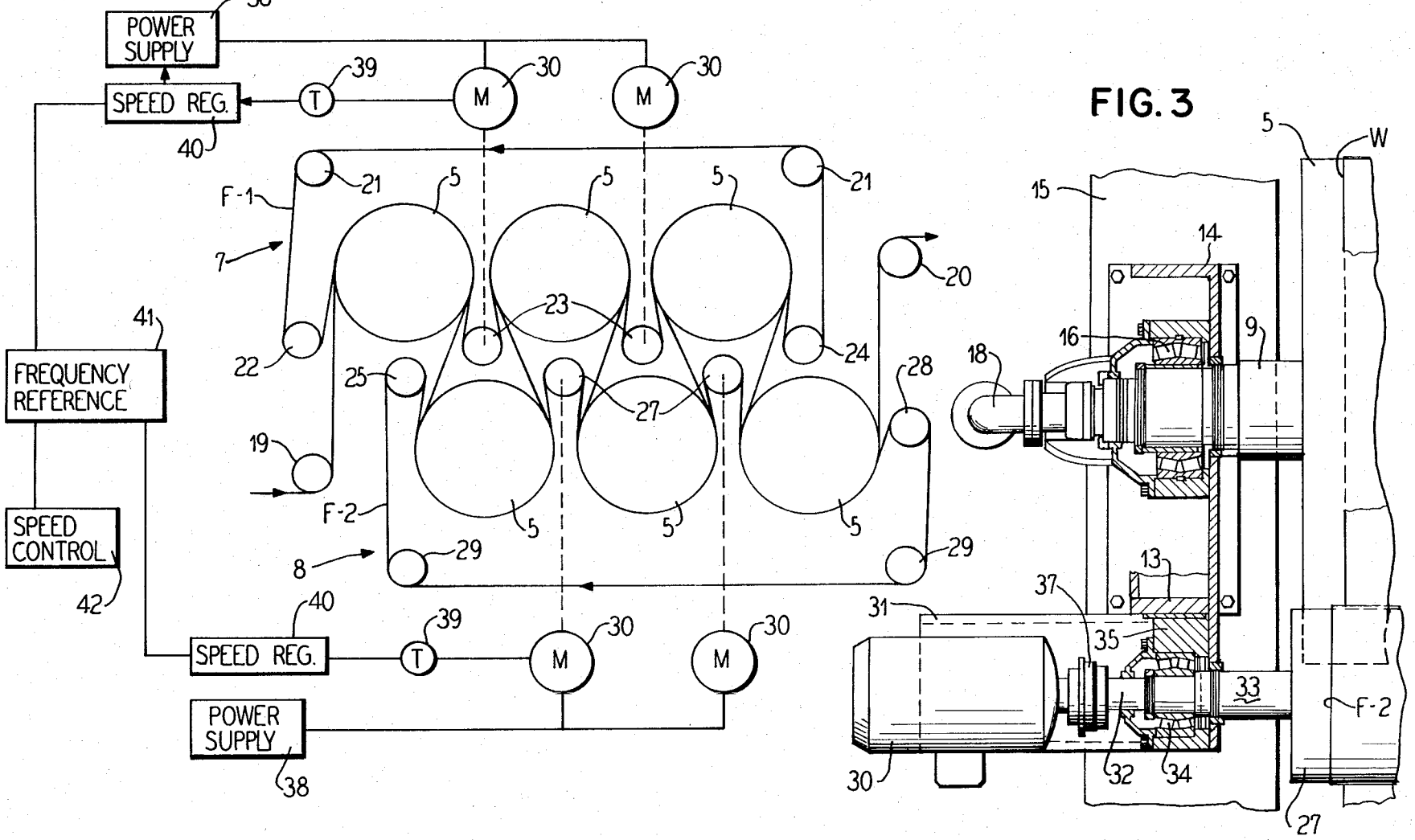
FIG. 3 is an enlarged sectional detail view taken substantially along the lines III—III of FIG. 1.
FIG. 4 is a diagrametic view depicting the dryer section drive and control system.

As best seen in FIGS. 1–3, each of the motors 30 is adapted to be mounted on a motor bracket 31 supported by the adjacent frame column 13 and with the motor shaft coaxially aligned with and coupled to an extension 32 from the shaft means or journal 33 extending from the end of the associated roller 23 or 27, as the case may be. Each of the journals 33 is rotatably supported by means of an anti-friction bearing 34 carried by a bearing support 35 mounted on the adjacent machine frame column 13 in association with the supporting bracket 31 of the coupled motor 30. Inasmuch as the felt rollers 23 and 27 are generally of much smaller diameter than the dryer rolls 5, for example in a ratio of 3 to 1, the speed of the felt rollers 23 and 27 is sufficiently high so that they may be driven directly by means of the shafts of the motors 30 without gear reducers. A coaxial coupling 37 may join the outer end of each motor shaft with the associated journal extension 32. However, for larger diameter felt rollers it may be desirable to have gear transmission drive coupling between the motor shafts and the journal extensions 32.

Although the felts F-1 and F-2 maintain the dryer rolls 5 in their respective tiers running in syncronism, inevitable variables may tend to cause drifting of either of the tiers 7 or 8 from syncronism with the other tier. To alleviate any such tendency, control means are provided for synchronizing one of the motors 30 of each of the tiers 7 and 8 with one of the motors of the other tier for thereby synchronizing the running speed of each roll tier with respect to the other roll tier. In a practical arrangement as represented in FIG. 4, each of the motors 30 of each tier is connected with a power supply 38 common to the motors 30 of that tier. One of the motors 30 of each tier is connected through a tachometer 39 or other speed sensing device for reacting through a speed regulator 40 and the power supply 38 for controlling the speed of the dryer rolls of that tier. The power supply 38 may be either variable voltage DC or variable frequency AC, but variable frequency AC is preferred, because then the individual drive motors 30 may be induction motors, and the voltage will vary directly with frequency. Since all of the motors 30 in each tier are in parallel relation, the associated dryer felt F-1 or F-2, as the case may be, will provide practical synchronism of the motors and dryers in each of the tiers.

To attain constant synchronism of each of the tiers 7 and 8 with respect to the other tier, a frequency reference 41 is provided for comparing frequency feedback from the motors 30 of each tier group through the speed regulators 40 of the tier groups. By thus assuring synchronus relationship of the two tiers of dryer rolls, the dryer 10 will function well within the stretchable range of the paper web W and the web will not break in the runs between the rolls 5 of the two tiers. The entire dryer section 10 can start up and run from standstill in a slow speed synchronous manner to accommodate threading of a new web into the dryer section, and the dryer section then caused to accelerate to full speed. Desirably, a draw adjustment or speed control device 42 is operatively connected with the frequency reference means 41.

From the foregoing, it will be apparent that the present invention affords numerous improvements and advantages, among which may be mentioned elimination of costly and complex gearing, and the provision of much simpler framing at the back of the dryer section. There is no need for gear reducers, which effects a considerable saving in original equipment cost. Savings are effected even during erection of the apparatus because less erection time will be required. No foundation for a large and heavy drive motor is required as has been prior practice. A more efficient and less costly driving arrangement results from the direct driving relationship of the drive motors with the dryer felt rollers for the unique driving of the dryer rolls by means of the dryer felts. Accessibility to the back of the dryer section, and air flow, is much improved by virtue of the elimination of the blockage caused by the conventional dryer roll drive gear casings. Hence, more even air distribution in the dryer section hood is attained. A much simplified oil system having regard to the roller and roll bearings is feasible. Dryer roll spacing is flexible and adjustments can be effected without regard to gear train involvment. Expansion joints and back lash provisions usually involved with dryer roll gear train drives are eliminated.

It will be understood that variations and modifications may be effected without departing from the spirit and scope of the novel concepts of this invention.

I claim as my invention:

1. In a paper making machine dryer section of the type having a plurality of rotatably mounted heated dryer rolls arranged in cooperative upper and lower tiers and each having a peripheral drum surface over which a paper web to be dried is adapted to be run in a sinuous path successively around the dryer rolls of the tiers, and respective dryer felts for guiding and holding the web onto the dryer roll peripheral drum surfaces in each tier, said felts also functioning to maintain substantial drum surface running speed synchronism of the rolls in the respective tier with which each felt is associated, the improvement comprising:

each of said dryer felts being trained over guide rollers exclusively for that felt and maintained under roll driving tension against said dryer roll drum surfaces;

a plurality of electrical felt driving motors operatively coupled respectively to the guide rollers of the upper tier felt;

a plurality of electrical felt driving motors drivingly coupled respectively to the guide rollers of the lower tier felt; and, means for synchronizing only one of said motors for each felt with only one said motors for the other felt for synchronizing the running speed of said dryer felts and thereby synchronizing the running speed of said roll tiers, and comprising a frequency reference device connected to respective speed regulators for each of said one motors, a tachometer connected between each of the speed regulators and each of said one motors, a speed control connected to said frequency reference device, and a power supply for all of said motors.

2. A dryer section according to claim 1, wherein said dryer section includes a frame having upper beam means supporting individual dryer roll supporting structures for the dryer rolls of the upper tier, base means having thereon individual support structures for rotatably supporting the dryer rolls of the lower tier, a respective upright column connected to and between each roll supporting structure for each upper tier dryer roll and the subjacent lower tier dryer roll supporting structure, and mount means carried by said columns for supporting said motors.

3. In a paper making machine dryer section of the type having a plurality of rotatably mounted heated dryer rolls arranged in cooperative upper and lower tiers and each having a peripheral drum surface over which a paper web to be dried is adapted to be run in a sinuous path successively around the dryer rolls of the tiers, and respective dryer felts for guiding and holding the web onto the dryer roll peripheral drum surfaces in each tier, said felts also functioning to maintain substantial drum surface running speed synchronism of the rolls is the respective tier with which each felt is associated, the improvement comprising:

each dryer felt for each tier having a plurality of electrical driving motors for driving exclusively the dryer felt in that tier; and means for synchronizing only one of the motors for each dryer felt with only one of the motors of the other dryer felt for synchronizing the running speed of each dryer felt of each roll tier with respect to the dryer felt of the other roll tier.

4. A dryer section according to claim 3, wherein each of said dryer felts has a plurality of rotary guide rolls located in loops of the respective felt disposed generally between said dryer roll tiers, each of said guide rollers having an individual driving of the motors, said means for synchronizing being in control of only one motor in each tier.

5. A dryer section according to claim 3, wherein said means for synchronizing comprises a frequency reference device connected to respective speed regulators for said one motor.

6. A dryer section according to claim 5, including tachometer means connected between said speed regulators and said one motors.

7. A dryer section according to claim 5, including a speed control connected to said frequency reference device.

8. A dryer section according to claim 3, wherein each of said dryer felts has a plurality of rotary guide rollers located in loops of the respective felt disposed generally betwen said dryer roll tiers, each of said guide rollers having an individual driving motor, said means for synchronizing being in control of said only one motor in each tier and comprising a frequency reference device connected to respective speed regulators connected to said one motor in each tier, tachometer means connected between said speed regulators and said one motor in each tier, and a speed control connected to said frequency reference device.

9. A method of operating and controlling a paper machine dryer section of the type having a plurality of rotatably mounted heated dryer rolls arranged in cooperative upper and lower tiers, and comprising:

running a paper web to be dried in a sinuous path successively around the dryer rolls of the tiers, guiding and holding the web only the dryer roller peripheral surfaces in each tier by engaging respective dryer felts in each tier and thereby maintaining substantial running speed synchronism of the peripheral surfaces of the rolls in the respective tiers with which each of the felts in associated;

training each of said dryer felts over guide rollers and thereby maintaining the felts under roll driving tension against the peripheral surface of the dryer rolls;

driving the guide rollers of the upper tier felt by operating a plurality of electrical felt driving motors;

driving the guide rollers of the lower tier felt by operating a plurality of electrical felt driving motors; and, synchronizing the driving of only one of the felt driving motors for each dryer felt with the only one of the felt driving motors of the other dryer felt and thereby synchronizing the running speed of each dryer felt of each roll tier and thereby the peripheral running speed of the rolls of that tier with respect to the dryer felt and the peripheral running speed of the rolls of the other roll tier.

10. A method according to claim 9, comprising providing each of said dryer felts with a plurality of rotary guide rollers located in loops of the respective felt disposed generally between said dryer roll tiers, providing each of said guide rollers with an individual driving motor, and effecting said synchronizing in respect to said only one motor in each tier.

11. A method according to claim 9, comprising effecting said synchronizing through a frequency reference device and referencing the frequency through a respective speed regulator for each of said one driving motors.

12. A method according to claim 11, comprising connecting between each of said one speed regulators and said driving motors a respective tachometer.

13. A method according to claim 11, comprising connecting a speed control to said frequency reference device.

14. In a paper making machine dryer section of the type having a plurality of rotatably mounted heated dryer rolls arranged in cooperative upper and lower tiers and over which a paper web to be dried is adapted to be run in a sinuous path successively around the dryer rolls of the tiers, and respective dryer felts for guiding and holding the web onto the dryer roll peripheral surfaces in each tier, said felts also functioning to maintain substantial running speed synchronism of the rolls in the respective tier with which each felt is associated, the improvement comprising:

each of said dryer felts being trained over guide rollers and maintained under roller driving tension against said dryer rolls;

a first electrical felt driving motor operatively coupled to at least one of the guide rollers of the upper tier felt;

a second electrical felt driving motor drivingly coupled to at least one of the guide rollers of the lower tier felt;

means for synchronizing said first motor and said second motor for synchronizing the running speed of said dryer felts and thereby synchronizing the running speed of said roll tiers, and comprising a frequency reference device connected to respective speed regulators for each of the motors, a tachometer connected between each of the speed regulators and each of said motors, a speed control connected to said frequency reference device, and a power supply for each of said motors; and said dryer section including a frame having upper beam beams supporting individual dryer roll supporting structures for the dryer rolls of the upper tier, base means having thereon individual support structures for rotatably supporting the dryer rolls of the lower tier, a respective upright column connected to and between each roll supporting structure for each upper tier dryer roll and the subjacent lower tier dryer roll supporting structure, and mount means carried by said columns for supporting said motors.

* * * * *

UNITED STATES PATENT AND TRADEMARK OFFICE

CERTIFICATE OF CORRECTION

PATENT NO. : 4,495,711

DATED : Jan. 29, 1985

INVENTOR(S) : Edgar J. Justus

It is certified that error appears in the above-identified patent and that said Letters Patent are hereby corrected as shown below:

Cover page under Related U.S. Application Data, delete second line which reads "now Defensive Publication No.".

Column 6, line 56, delete "of the" and change "motors" to --motor-- line 57, insert --of the-- between "one" and "motor" and change "motor" to --motors-- line 62, change "motor" to --motors--.

Column 7, line 24, change "in" to --is-- line 27, change "surface" to --surfaces--.

Signed and Sealed this

Eleventh Day of June 1985

[SEAL]

Attest:

DONALD J. QUIGG

Attesting Officer

Acting Commissioner of Patents and Trademarks